US006945640B2

(12) United States Patent
Cheok

(10) Patent No.: US 6,945,640 B2
(45) Date of Patent: Sep. 20, 2005

(54) REFILL STATION

(75) Inventor: Tan Kong Cheok, Jurong (SG)

(73) Assignee: Inke Pte. Ltd., Singapore (SG)

( * ) Notice: Subject to any disclaimer, the term of this patent is extended or adjusted under 35 U.S.C. 154(b) by 0 days.

(21) Appl. No.: 10/789,580

(22) Filed: Feb. 26, 2004

(65) Prior Publication Data

US 2004/0257409 A1 Dec. 23, 2004

(51) Int. Cl.[7] ..... B41J 2/175; B41J 2/18
(52) U.S. Cl. ..... 347/85; 347/89
(58) Field of Search ..... 347/7, 85, 87, 347/89, 90; 141/2, 18, 21, 115–116, 121–123, 198, 378

(56) References Cited

U.S. PATENT DOCUMENTS 4,383,263 A * 5/1983 Ozawa et al. ..... 347/30
5,291,215 A * 3/1994 Nozawa et al. ..... 347/18
5,367,328 A * 11/1994 Erickson ..... 347/7
5,704,403 A * 1/1998 Schwenk et al. ..... 141/18
5,936,650 A * 8/1999 Ouchida et al. ..... 347/89
6,039,442 A * 3/2000 Hagiwara et al. ..... 347/89
6,231,174 B1 * 5/2001 Haigo ..... 347/89
6,799,842 B2 * 10/2004 Barinaga et al. ..... 347/85

* cited by examiner

*Primary Examiner*—Anh T. N. Vo
(74) *Attorney, Agent, or Firm*—Blakely Sokoloff Taylor & Zafman

(57) ABSTRACT

A refill station adapted to dock an ink replenishment cartridge and a printer cartridge to have its ink replenished using a flow system whereby cannula or needle interconnection with the system of the cartridges allows electronic monitoring and sequencing of the operations. The flow system has threshold valving, at least one damped route, at least one by pass route and a pump whereby ink can be cleared from the printer cartridge and be replaced by more ink from the replenishment cartridge. Pressure relief and ink quality maintenance procedures are embodied in flow system.

21 Claims, 12 Drawing Sheets

REFILL STATION

TECHNICAL FIELD

The present invention relates to an ink refilling device, more particularly, to an ink jet printer for refilling a printer cartridge.

BACKGROUND ART

Ink jet printers are each equipped with an ink container for supplying ink to the print head. A replaceable printer cartridge is widely used as the means for providing the new supply. Such printer cartridges may be in the form of a simple ink container or in a form that is unified with a printer head. In the present application, the term "printer cartridge" covers both types and therefore can include a replaceable cartridge, at least a part of which constitutes an ink container.

Disposable printer cartridges have a head portion and an ink containing portion capable of supplying ink to the head portion. The ink containing portion is usually made of a non-transparent material for the purpose of protecting the properties of the ink in the container thereof.

Today, a majority of the printer cartridges for ink jet printers sold are a one-way product, i.e. it has to be discarded after the depletion of the ink supply. This is highly undesirable on economic reasoning since such depleted printer cartridges, but for their ink depletion, are still functional and this includes especially, valuable components such as the nozzle plates through which ink is ejected.

In addition, environmental concerns also call for the "reuse" of printer cartridges.

Accordingly, it is desirable to provide an apparatus that is capable of refilling printer cartridges. With such objective, there is a widely used method whereby an ink supply container in the form of a simple injector mounts to a joint portion of the printer cartridge, and the ink container is caused to collapse thereby to inject ink into the printer cartridge to render the printer cartridge reusable.

One disadvantage of such a prior art refilling method is that the quality of ink required in the printer cartridge is uncertain since the ink container of the cartridge is not visible. This is especially so where refilling is to be as a precautionary exercise, ie; before full depletion. Moreover, where the ink being supplied to the printer cartridge is supplied at an excessive pressure or at an excessive rate its flow can divert. Therefore, a desired quantity of ink may not be properly delivered.

Manual refill kits for printer cartridges are available in the market. However, such manual refill kits come with too many parts and they require lengthy procedures to be followed by users in order to affect the refill process. If users are not familiar with the refilling procedure, it can result in ink leaking from the cartridge during the refilling process and thus causing an unnecessary mess to the users' equipment.

To overcome at least some of these difficulties or to provide an alternative to such ink refilling supplies and apparatus and such ink refilling method one or more of the following is desirable:

1. The quantity of the ink required for the ink refilling process is as close as possible to the quantity of the ink filled into the printer cartridge. While usage efficiency of the refilling ink can be achieved, it too enables the size of the consumable ink supply device to be reduced.

2. The method of refilling is simplified and thus users can affect the refill easily.
3. The refilled printer cartridge is still capable of providing high quality printing.

SUMMARY OF THE INVENTION

The present invention has as at least one of its objects an improved or alternative method for refilling a printer cartridge. The invention as a whole preferably is to make refilling process more secure, easy and less prone to spilling occurrences. Other objects include the apparatus, consumables and systems thereof.

The present invention preferably is to provide a device for smooth, clean, cheaper and safe refilling process of a printer cartridge. In this connection, preferably the transferring of ink from an ink replenishment cartridge to use in refilling a printer cartridge is via various conduits (eg; tubes) using a pump (preferably driven by motor) with the refilling process overall being preferably monitored and controlled by an electronic controller.

Another and/or an alternative object of the present invention is to provide an efficiency and high quality refilling process.

In a first aspect the present invention consists in apparatus for refilling a printer cartridge, said apparatus having a dock for a printer cartridge, a dock for an ink replenishment cartridge (having an ink receiver) and a flow system including a pump, valving and conduits, wherein, in use, said flow system can interconnect with its said conduits at least a docked said printer cartridge and a docked said ink replenishment cartridge, wherein there is, in addition, an ink receiver or the ink replenishment cartridge, when docked, is to provide an ink receiver, and wherein the flow system is operable in each of the following modes in use:

(a) a draw off mode to take ink from within a docked printer cartridge into the ink receiver, (b) an ink supply mode to supply ink from within a docked ink replenishment cartridge into a docked printer cartridge, and (c) an ink re-routing mode to reroute ink taken into the flow system from within a docked ink replenishment cartridge in mode (b) operation, such rerouting being to (1) at least cycle some of the ink, (2) discharge to the ink receiver at least some of the ink, or (3) both (1) and (2).

Preferably the flow system is subject to, at least in part, electrical control of the pump and/or valving of at least one of the conduits after being initiated whereby the flow system can operate in mode (a) and then (ii) while having at least the possibility of acting wholly or in part in mode (c), can operate in mode (b).

Preferably said flow system is operable in a further mode, mode (d), whereby there is a draw off of some fluid from within a mode (b) filled or part filled docked printer cartridge.

Preferably there is a programmed or electronic control of the pump and/or valving of at least one conduit of the conduiting of the conduits whereby the flow system iterates the sequence of (I) mode (b) alone, or both modes (b) and (c), and (II) mode (d).

Preferably the flow system includes an electrically controlled pump capable of operating in two directions.

Preferably the pump and valving in the flow system prevents any substantial reverse flow of ink to the flow direction(s) in mode (b) yet will allow for ink within part of the flow system and, if above a threshold pressure, at least some routing of ink to the ink receiver.

Preferably the flow system in mode (b) filters the ink supply prior to its passage into a docked printer cartridge.

Preferably there is an electronic control of at least some of the flow system mode parameters responsive to sensors capable of detecting any one or more of the presence of a docked printer cartridge, the presence of an ink replenishment cartridge, the status of a docked printed cartridge, the status of a docked ink replenishment cartridge, ink status in the flow system, the integrity of the flow system, and the integrity of the flow system relationship with any one or more of the printer cartridge, the ink replenishment cartridge and the ink receiver.

Preferably said ink replenishment cartridge is docked in the dock therefor and said ink replenishment cartridge includes said ink receiver.

Preferably said flow system is connected to one or more of the ink replenishment cartridge, the ink receiver and the printer cartridge by a cannula.

In another aspect the present invention consists in, in combination, apparatus of the present invention, and one or both a dockable printer cartridge, and a dockable ink replenishment cartridge.

Preferably said ink replenishment cartridge includes said ink receiver.

Preferably a said docking cannula connects to the flow system.

In yet another aspect the present invention consists in a method of refilling a printer cartridge which comprises or includes (I) connecting all of (1) the ink supply reservoir of an ink replenishment cartridge, (2) the ink reservoir of a printer cartridge and (3) an ink receiver (whether part of said ink replenishment cartridge or not) into a connecting flow system, and, (II) using the flow system, (a) drawing off at least some of any ink from within the ink reservoir of the printer cartridge and passing that fluid into the ink receiver, (b) supplying ink from the ink supply reservoir of the ink replenishment cartridge into the ink reservoir of the printer cartridge, and (c) halting the at least net feeding of ink from the flow system into the ink reservoir of the printer cartridge in the eventuality (i) the ink replenishment cartridge is empty of ink, and (ii) the ink reservoir of the printer cartridge is full of ink, such halting of the supply of ink, in the eventuality that the ink reservoir of the printer cartridge is full, involving a diverting or cycling in the flow system, of ink taken from within the ink replenishment cartridge into the flow system (e.g. even as or prior to supply from the ink replenishment cartridge into the flow system being terminated. Preferably step (a) and step (b) require opposite rotation of a pump in said flow system.

Preferably as a step (d), there is a relieving of pressure from within the ink reservoir of the filled printer cartridge by drawing off some fluid therefrom into the flow system.

Preferably said flow system (with at least one cannula) docks to at least the ink replenishment cartridge using a cannula.

DETAILED DESCRIPTION OF THE INVENTION

Figure 1:
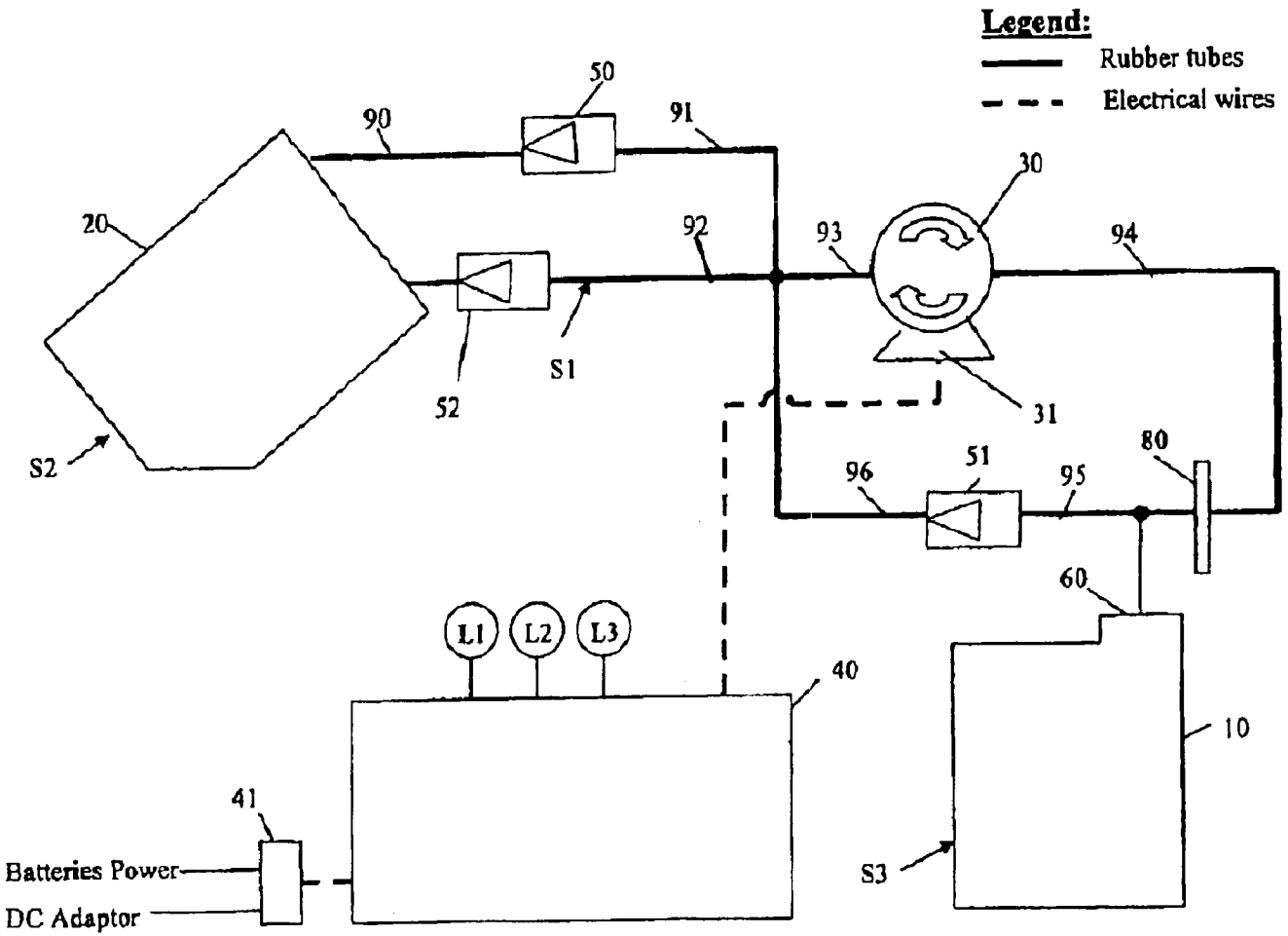
FIG. 1 is a flow diagram of a diagrammatically depicted printer cartridge and a diagrammatically depicted ink replenishment cartridge showing the flow system connecting thereto and showing in relation to the flow system an electronic control module.
Figure 2:
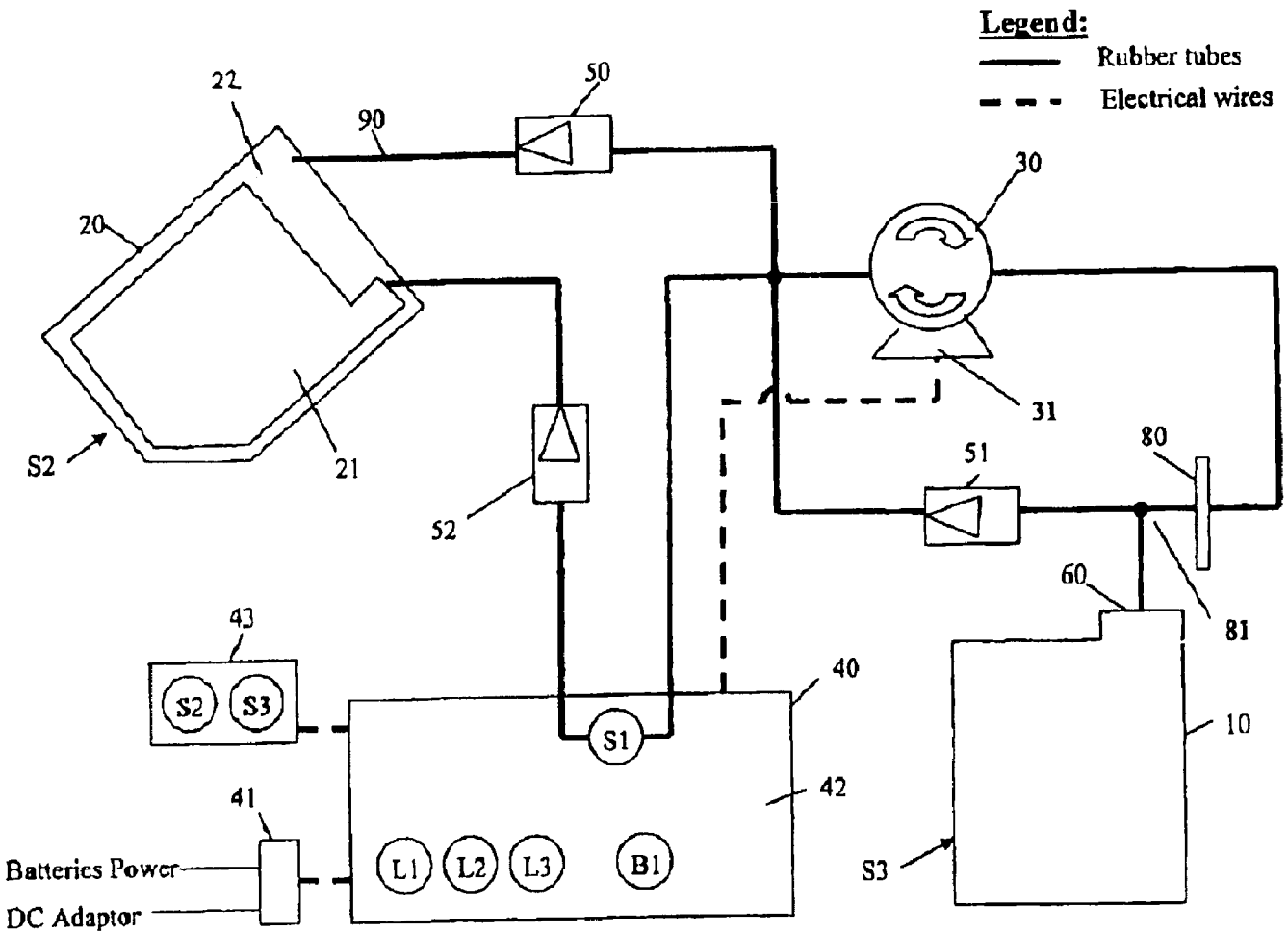
FIG. 2 is a similar view to that of FIG. 1 shown in more detail.

The present invention offers the users a method to refill a printer cartridge of their ink jet printer without difficulty.

The present invention preferably comes with a holder tray to enable the printer cartridge and the ink replenishment cartridge be simply located as part of a docking procedure. By closing the holder tray, the printer cartridge will then in contact with a sealing rubber within the device, so to complete the communication between the printer cartridge and the flow system includes conduits (eg; plastic tubes) and a bidirectional a pump.

Various light indicators and sensors are incorporated. Once the holder tray is properly closed, these light indicators and sensors are able to indicate to the user that the printer cartridge and/or the ink replenishment cartridge are now present in the device system respectively.

The ink replenishment cartridge within the device is in connection with the filling circuit of the flow system via two metal needles or cannula. These needles will each penetrate through a rubber seal of the ink replenishment cartridge, one in the ink supply chamber (eg; a collapsible blow moulded bottle) and the ink receiver defined in the cartridge housing. See our patent applications filed simultaneously herewith. The two preferably metal needles together with a motorised pump ensures movement of the refill ink via various linked tubes as well as receipt of waste ink thus can be effected.

The pump is preferably capable to perform a reversing pumping direction. With such function, waste ink can then be transferred back to the ink receive or receptacle chamber of preferably the ink replenishment cartridge.

The overall system includes various valves. These valves are installed not only to regulate pressure and to prevent excessive pressure, but also enable control of the amount of or onset of the ink return to ink receiver. As such, the designed valves are to assist in minimizing the risk of ink bursting free of the apparatus while controlling the amount of wasted ink from the filling process. Another pressure pre-settable check valve 52 is installed to prevent ink return to ink supply chamber 21.

A T-joint within the conduiting of the flow system allows the striking of a balance between the required degree of pressure and the ink flow rate. As a result, ink flow is gentler and the resultant print quality of the refilled printer cartridge will be better.

The flow system also includes a damper or filter which locates in between the pump outlet and inlet to the printer cartridge. The damper is capable of performing a double filtering function (so it helps to filter off and prevent unwanted particles from entering the printer cartridge). Such a filtering/damping effect leads to noise reduction as well as a reduction of clogging the printer cartridge's printing nozzle. The damper is also able to absorb (ie; damp) pulses and reduces bubbles. In this connection, it helps smoothing the ink flow prior to the ink filling into the printer cartridge.

The damper thus has significantly improved the filling ability of the system and the quality of ink.

The present invention is designed in such a manner that various sensors and light indicators are connected to a central control device (electronic controller), so to ensure a close monitoring as well as controlling of the refill process while it is taking place. The electronic controller preferably provides an automatic processing means whereby users will have a simple operation by just pressing one button to start and stop the refill process once the ink cartridge is fully filled.

The apparatus can either run by battery power or via appropriate DC voltage adaptor as individual user's needs.

FIG. 1 is a flow diagram showing the filling of a depleted printer cartridge 10 by transferring ink from the ink replenishment cartridge 20 by means of tubes 90 to 96 using pump 30 driven by a motor 31. The overall filling process is monitored and controlled by the electronic controller 40.

The printer cartridge 10, as well as the ink replenishment cartridge 20 are simply dropped into a holder tray. Upon closing of the holder tray, the printer cartridge 10 is in contact with a sealing rubber with which it seals. The contact and sealing completes communication between the printer cartridge and filling circuit formed by tubes 90 to 96 and pump 30.

The circuit is controlled by electronic controller 40 which contains sensors S1, S2, S3 and LED light indicators L1, L2, L3. On proper closing of the holder tray, the printer cartridge 10 activates sensor switch S3 indicating the presence of printer cartridge in the system.

The ink replenishment cartridge 20 is in connection with the filling circuit via two metal needles or cannula that penetrate through a rubber seal (not shown) in the ink tank of the cartridge. One of the needles is in fluid communication with the ink supply chamber 21 in the ink replenishment cartridge 20 that supplies ink to be transferred into the printer cartridge 10. The other needle is in communication with the ink receiver or receptacle chamber 22 in the ink replenishment cartridge 20 to receive any excess or waste ink produced in the filling process. The ink supply channel passes through an ink sensor S1 allowing the electronic controller 40 to monitor the availability of ink to be supplied to the printer cartridge 10. On proper closing of the holder tray, the ink replenishment cartridge 20 activates sensor switch S2 indicating the presence of ink replenishment cartridge in the system.

A pressure pre-settable check valve 51 is installed to regulate pressure within the system to prevent excessive pressure that may cause ink to burst from the apparatus (from areas such as disconnected tubes, joint, cartridge sealing and etc.).

Another pressure pre-settable check valve 50 is installed to regulate and control amount of excess ink return to the ink receiver or receptacle chamber to minimize the amount of waste ink from the filling process.

The entire system can be run either by battery power or power from appropriate DC voltage adaptor.

The apparatus is preferably provided in a housing.

The embodiment as shown in FIG. 2 to FIG. 5 helps to explain the working principle of the device. The device is to fill from the ink replenishment cartridge 20 the printer cartridge 10. The electronic control device 40 monitors filling status through various sensors signals. Various statuses are reflected to users through displays of lighting condition on series of LEDs L1, L2 and L3. The filling completes and stops automatically when all ink in the ink replenishment cartridge 20 has been filled to the printer cartridge 10 and the sensor S1 detected no ink supply in the supply channel. All electronic parts are mounted on a printed circuit board, PCB 42.

The system is activated when the main switch 41 is switched to "power on" position. The control electronic 40 scans various sensors data and displays their status accordingly. In the start up stage, there is neither printer cartridge nor ink replenishment cartridge in the device. The sensors pick up the absence of both the printer cartridge and ink replenishment cartridge and displays red color on LED L1. In this stage, nothing will happen even when a user presses the start button switch B1 trying to start the filling process.

For proper filling, printer cartridge 10 and ink replenishment cartridge 20 are both dropped onto a holder tray as part of the docking procedure. The holder tray is slid out to expose the seating position of the printer cartridge and ink replenishment cartridge when the device door is opened. With both printer cartridge and ink replenishment cartridge properly seated, the door as well as holder tray can then be slid back to the closed position. In the door fully closed position, the printer cartridge activates sensor S3 and the ink replenishment cartridge activates sensor S2. Control electronic 40 continuously monitors the system and senses the presence of both print cartridge and ink tank and to indicate that status and that the door is closed properly, it changes the LED L1 to display green color light to signify that the system is now ready for the filling process.

User presses start button switch B1 to now activate the filling process. Control electronics 40 now changes the LED L1 to display a blinking green light indicating that the device is now in the filling process. The process starts with a reverse pump direction to withdraw air in the printer cartridge and any possible waste ink left in the printer cartridge (This is subsequently called the vacuum process). It also helps clear minor nozzle clog that may be caused by the printer cartridge having been left for a period of time before refilling. The initial vacuum process stops after a pre-determined time is up.

Figure 3:
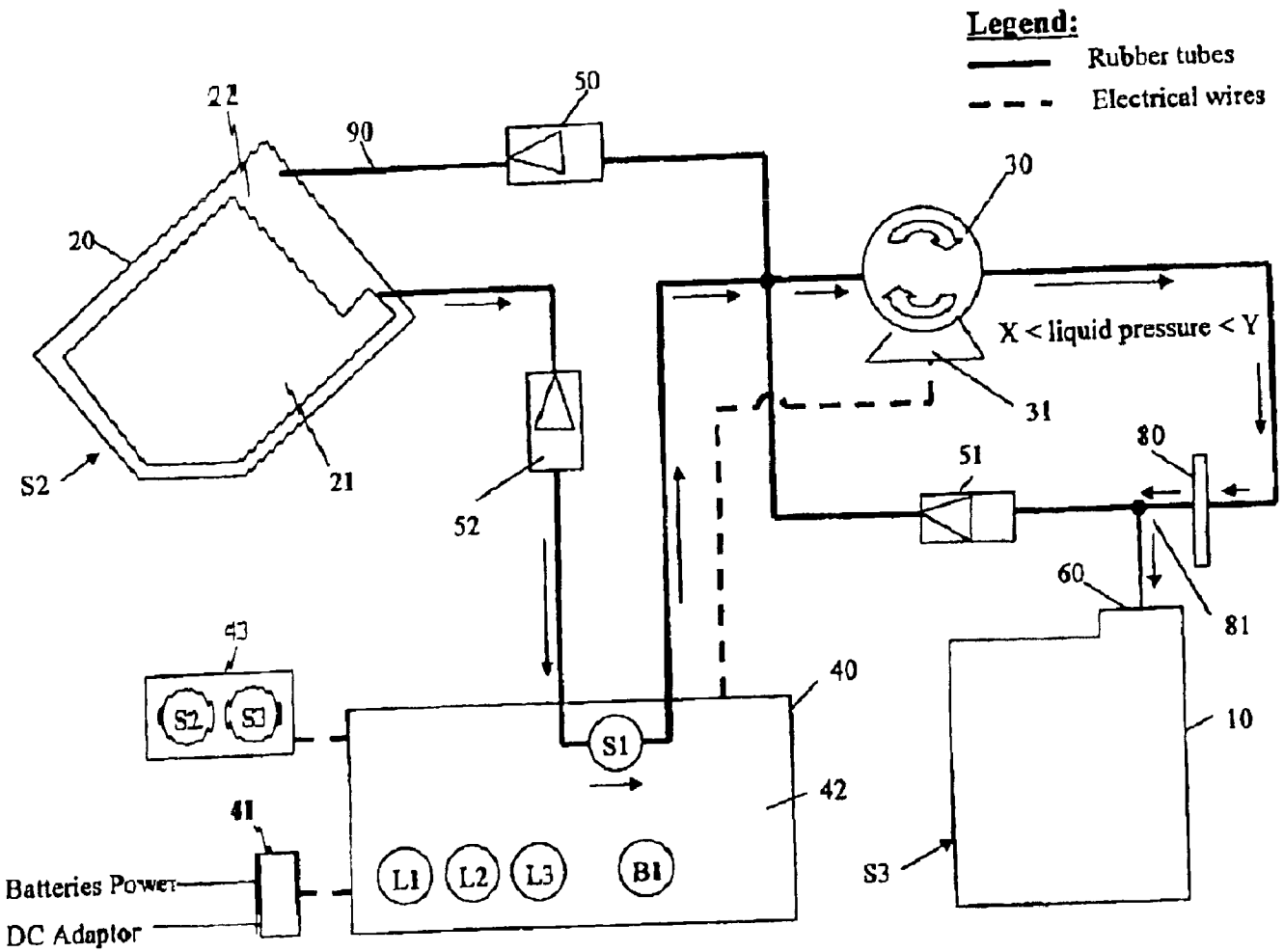
FIG. 3 is still a further variant of the arrangements of FIGS. 1 and 2.

The system process now activates the actual ink filling process that has the pump 30 rotating in a forward direction that will draw ink from the ink chamber 21 in the ink replenishment cartridge 20 and move it in the print cartridge 10 direction as shown in FIG. 3. The first filling cycle is to run to a pre-determined time to fill up ink in the tubes 90 to 96. The control electronic 40 will not check for ink supply status now as the tubes are all empty. At the end of the first filling cycle, some of the air in the empty tubes has been forced into the printer cartridge 10. Therefore, a vacuum cycle is activated for a short period to withdraw the air from the printer cartridge 10.

Figure 4:
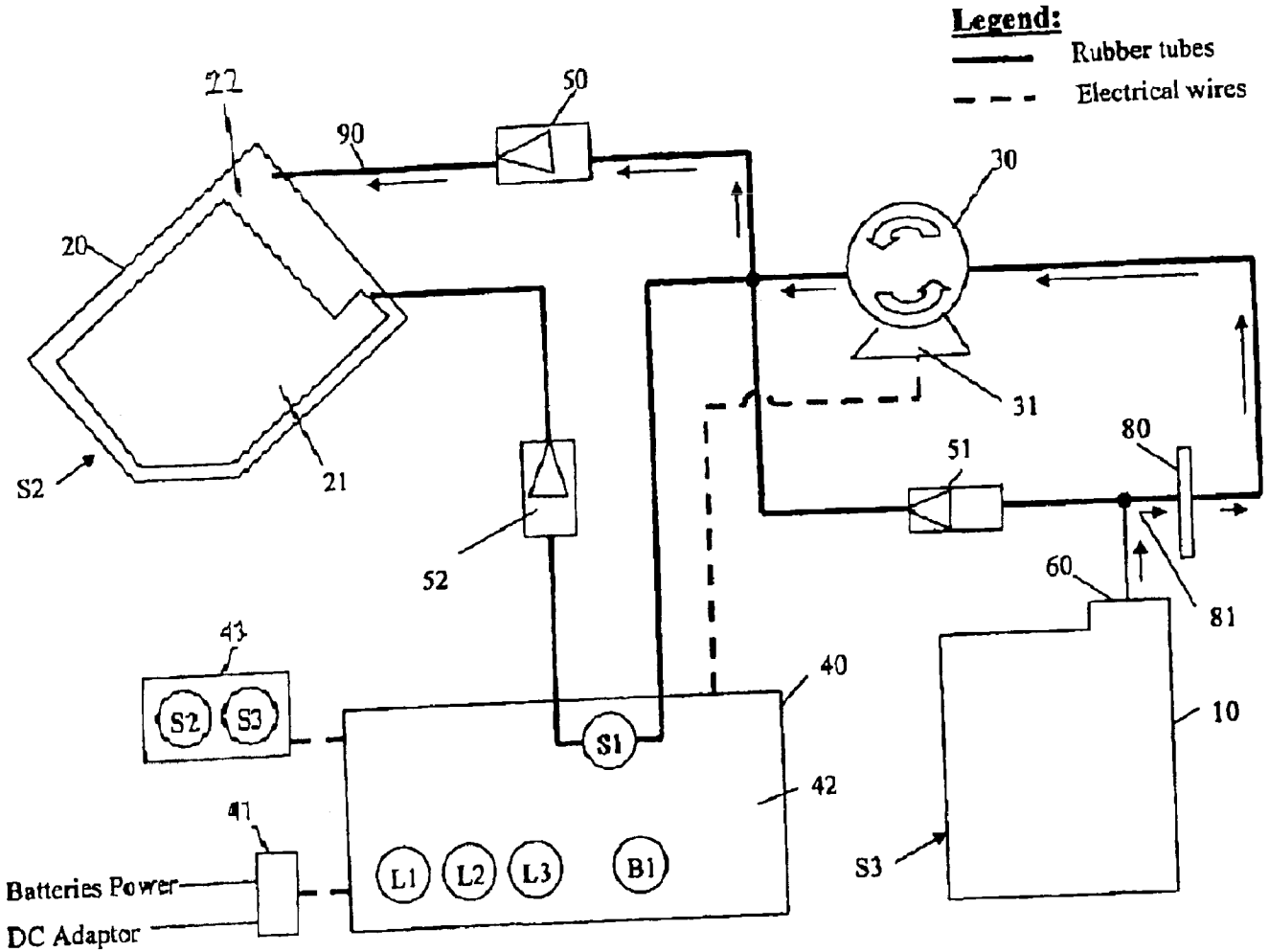
FIG. 4 is still a further variant of the arrangements of FIGS. 1, 2 and 3.

The ink filling process starts again to fill ink into the printer cartridge 10. Control electronics 40 now monitors the ink supply channel to ensure that there is an ink supply to be filled in the printer cartridge 10. The ink filling process is carried out for a period of time. While ink is filling into the printer cartridge, there might be some air being introduced into the printer cartridge 10 as well. Hence, there could be a pressure build up inside the print cartridge and a slowing down of the filling rate. At this stage, the control electronic stops the pump for a very short while and activates the vacuum process. This is achieved by reversing the pump to backward direction as shown in FIG. 4. The vacuum process reduces pressure inside the printer cartridge 10 and withdraws air from the printer cartridge 10 as well. The air withdrawn from the printer cartridge 10 is in tiny bubble forms and may otherwise contaminate ink in the supply channel. It is to be discharged out of the tubing system into the ink receiver or ink receptacle chamber 22 in the ink replenishment cartridge 20.

The ink discharge channel is installed with another pressure check valve 50. The pressure check valve 50 enables bubbled ink (subsequently called waste ink) to be pressurized and compressed before discharging. This ensures that air bubbles are collected before the pressure check valve 50 and discharge first when the pressure check valve 50 is opened. The arrangement minimizes the amount of ink discharged out of the system and maximizes ink filled into the printer cartridge 10.

The ink filling and vacuum cycle is repeated continuously while the control electronic 40 continues to monitor various sensors and switches status.

Figure 5:
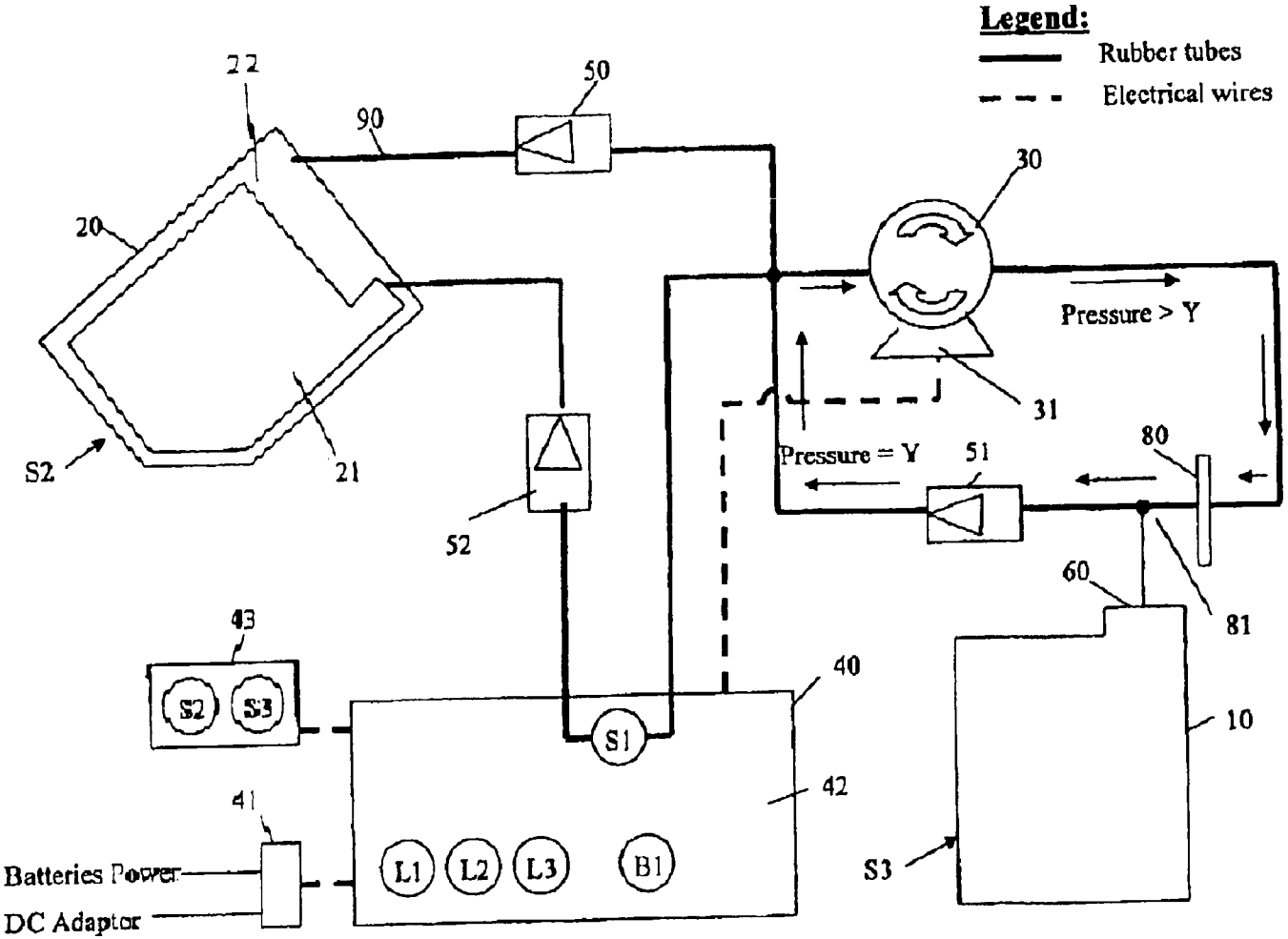
FIG. 5 is yet another variant of the arrangements of FIGS. 1, 2, 3 and 4.
Figure 6:
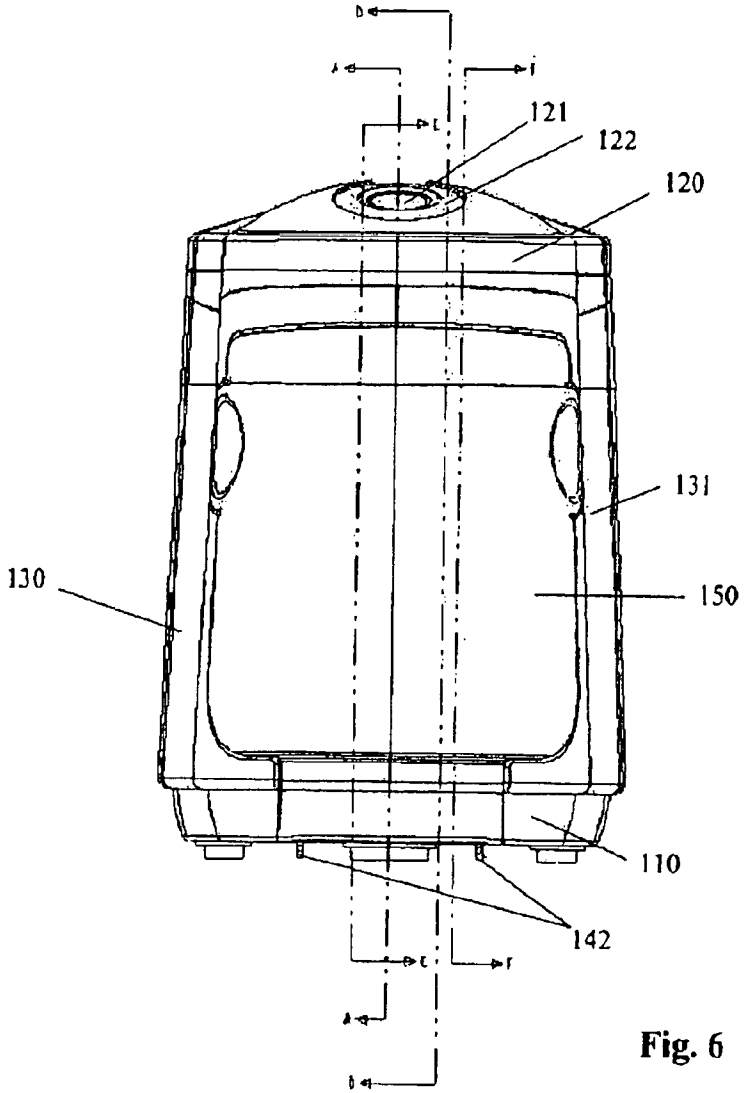
FIG. 6 is an end elevation view of a preferred embodiment of the present invention.
Figure 7:
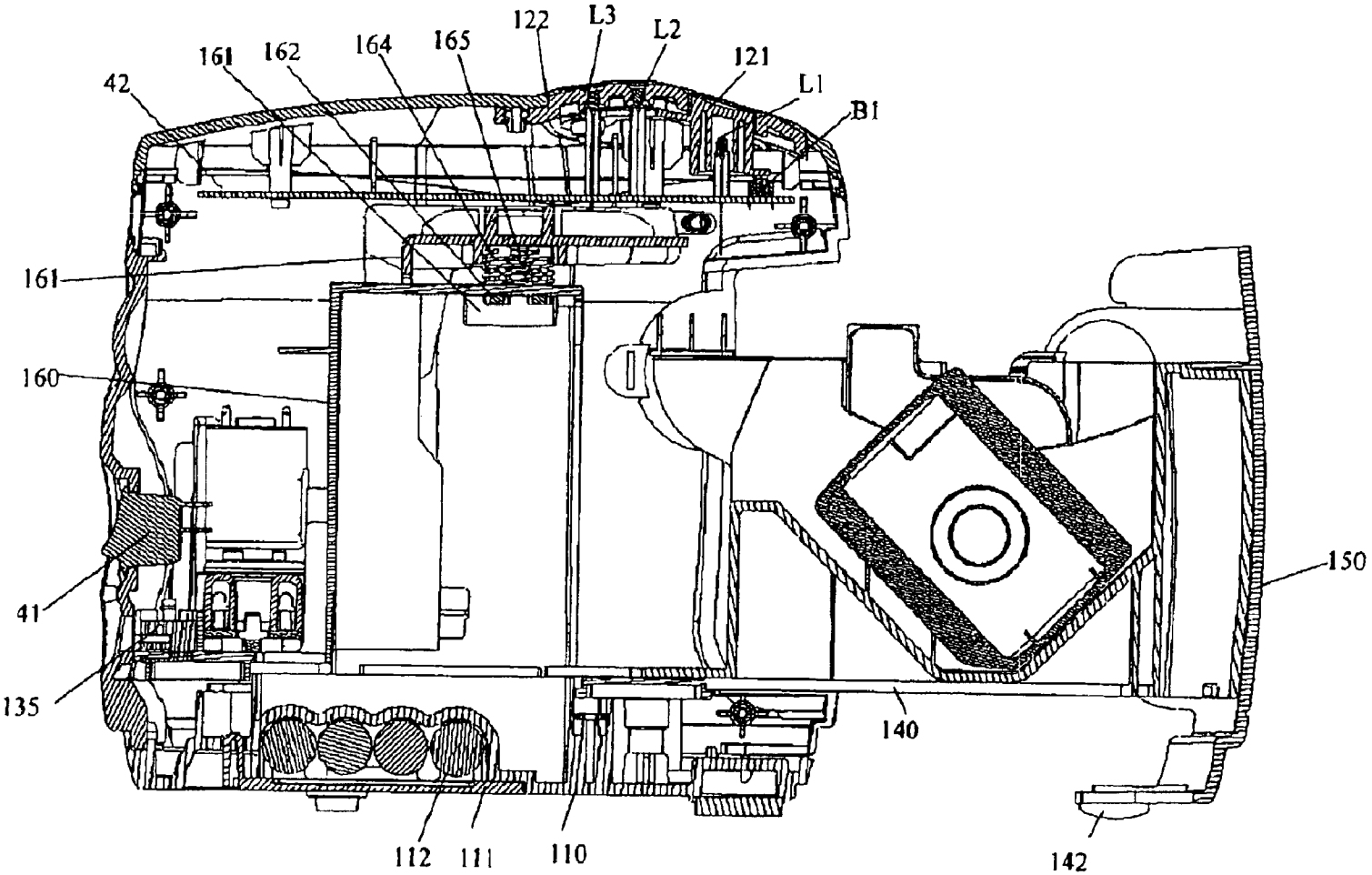
FIG. 7 is a side elevation in section of the embodiment of FIG. 6.
Figure 8:
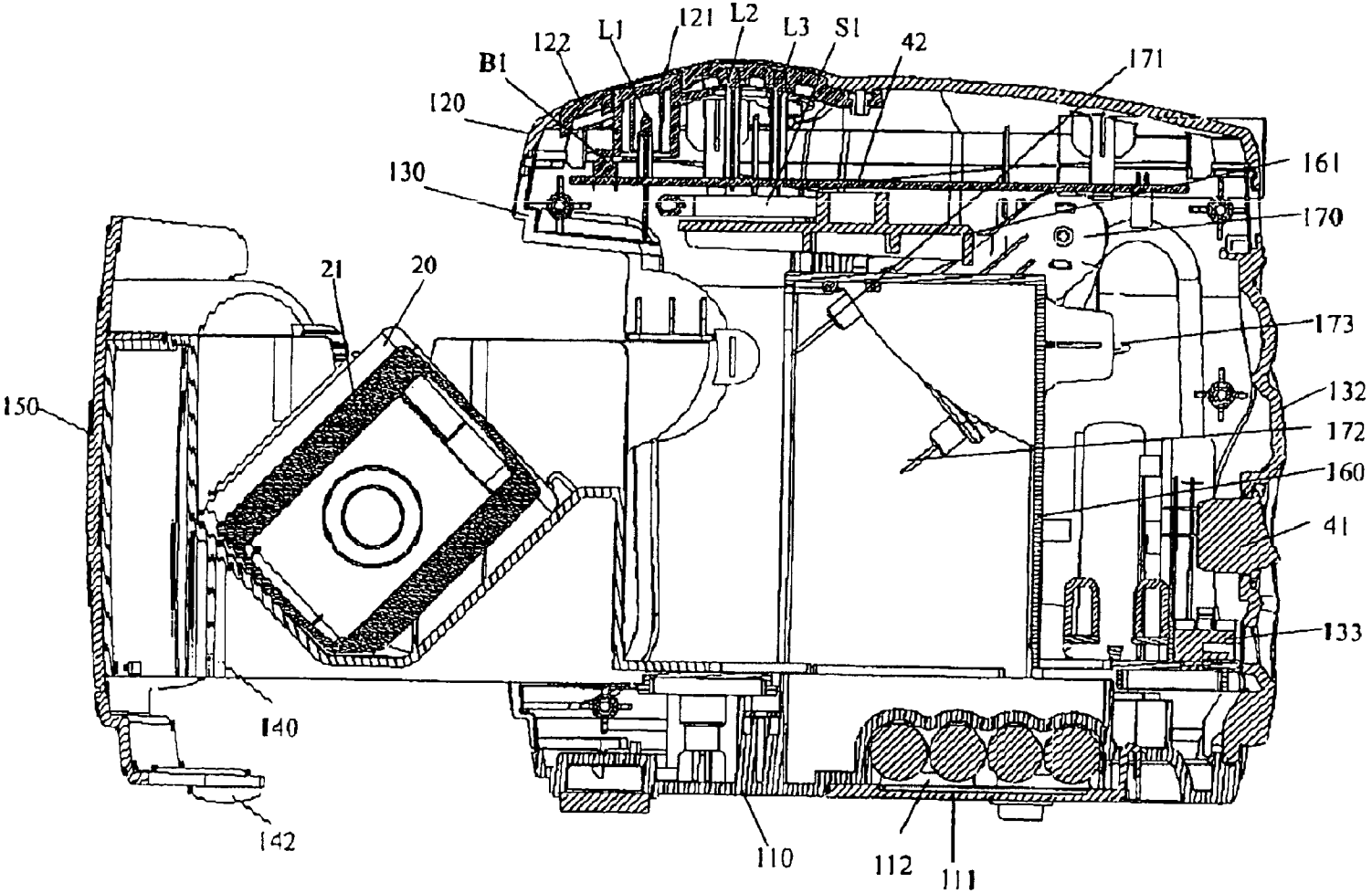
FIG. 8 is a reverse (with respect to FIG. 7) side elevation in section of the embodiment of FIG. 6.
Figure 9:
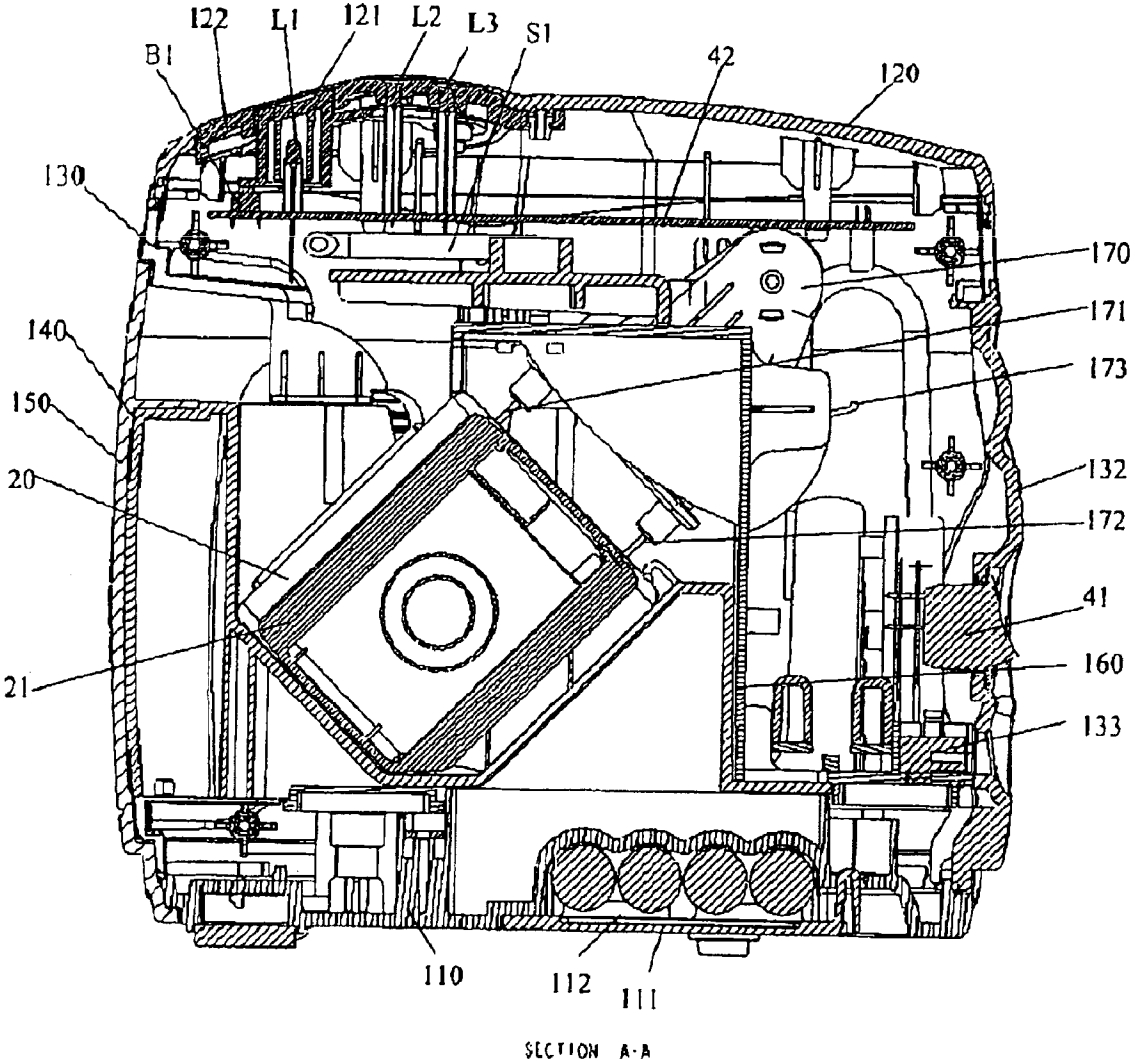
FIG. 9 is the section A—A with respect to FIG. 6.
Figure 10:
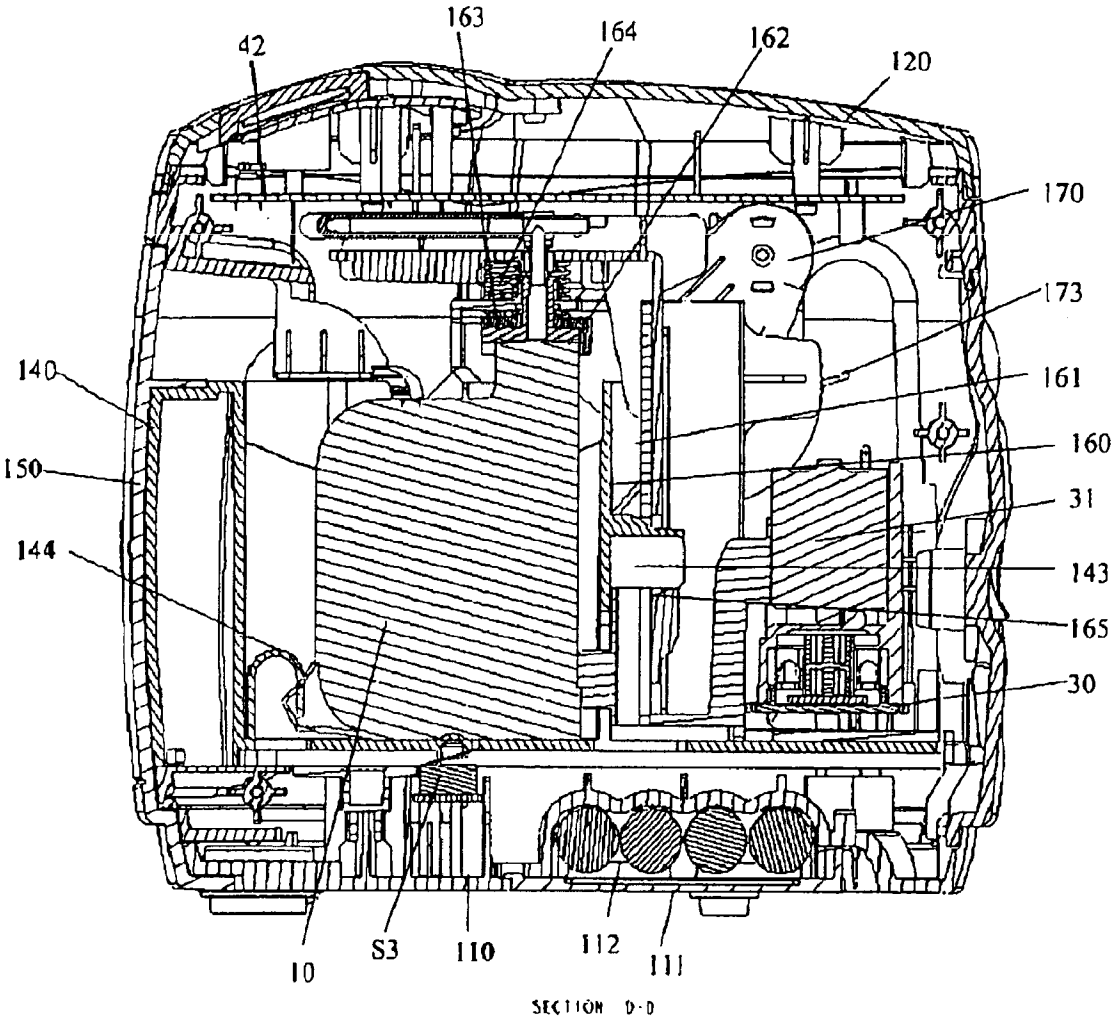
FIG. 10 is the section D—D with respect to FIG. 6.
Figure 11:
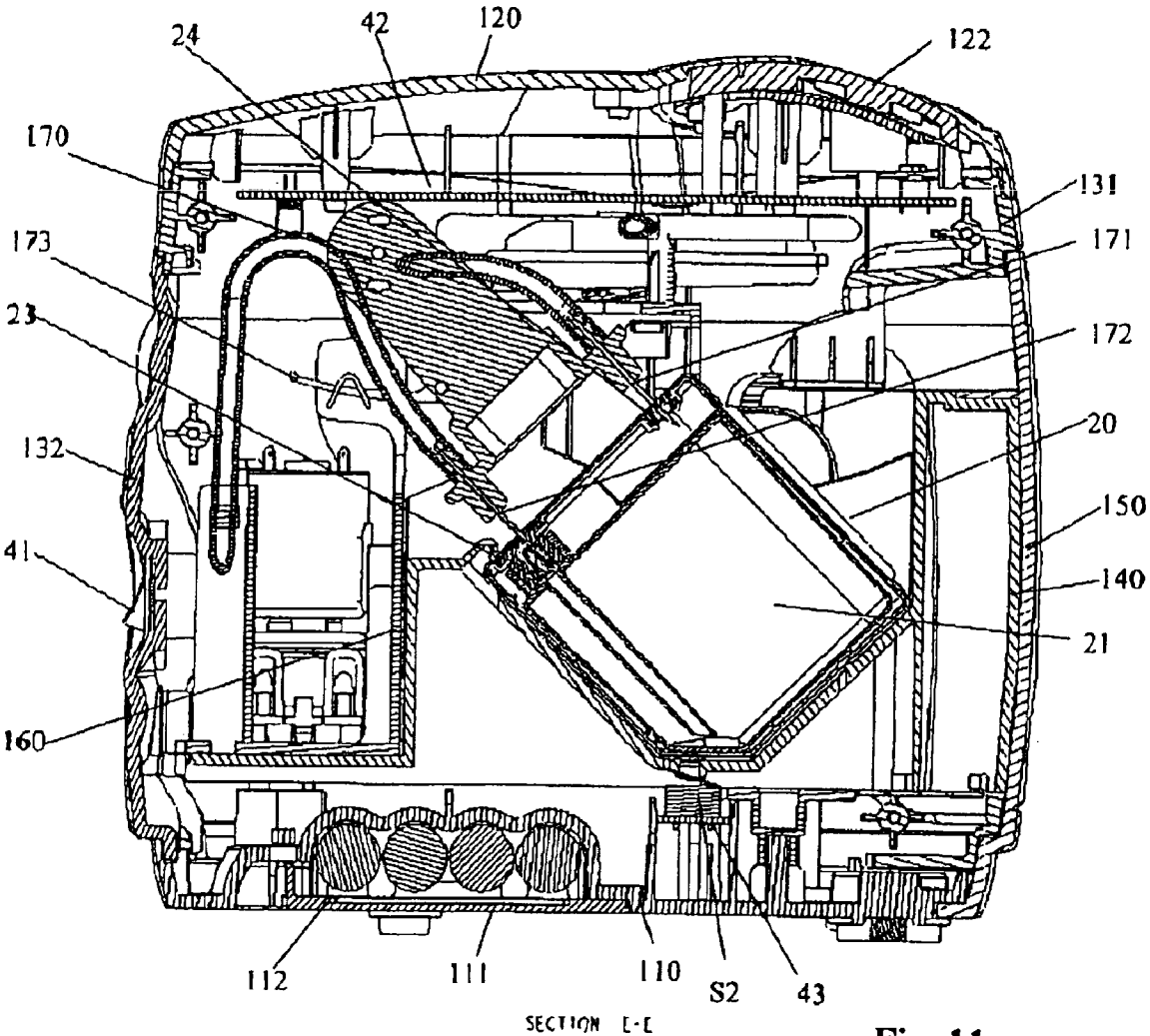
FIG. 11 is the section E—E with respect to FIG. 6.
Figure 12:
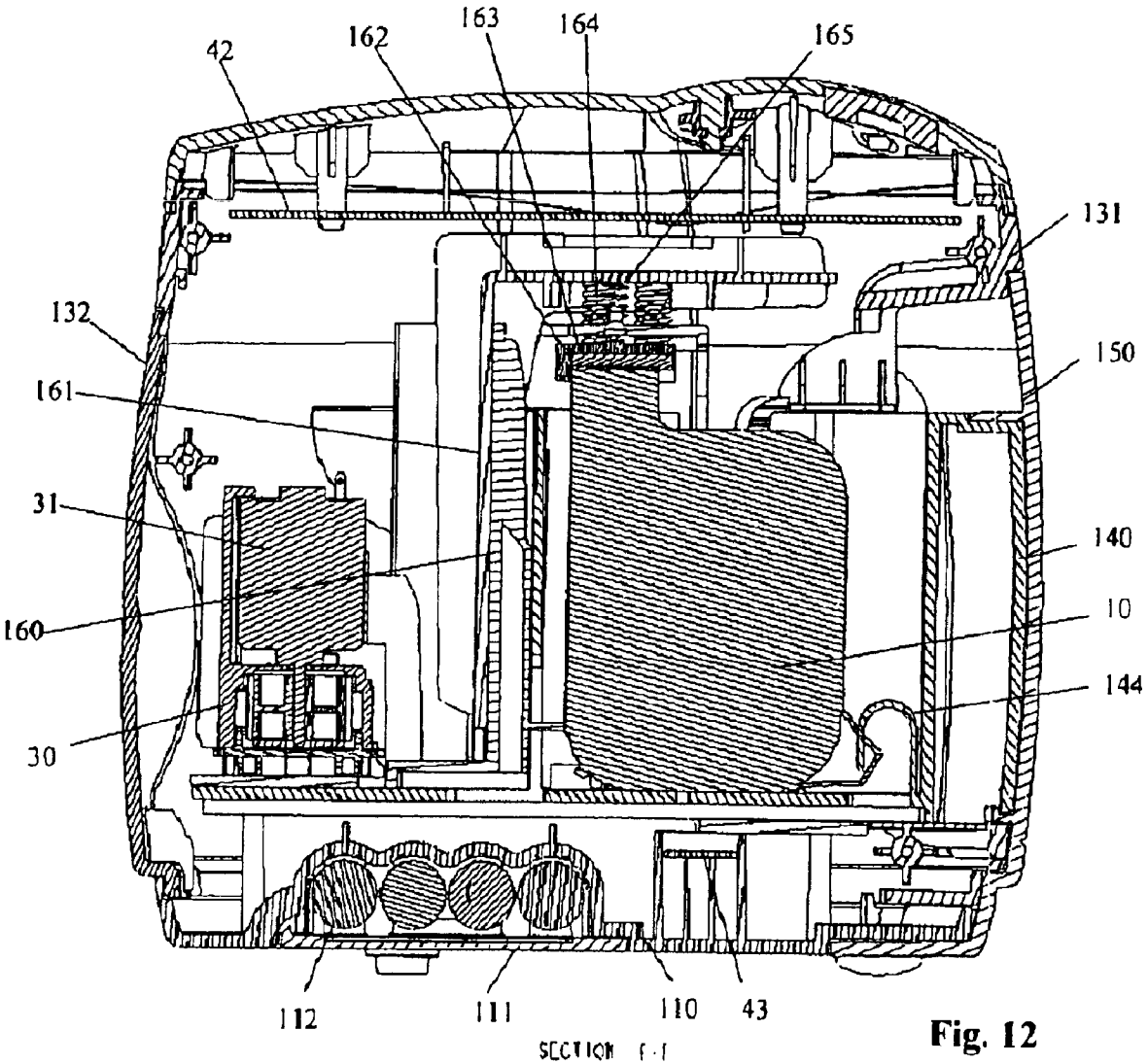
FIG. 12 is the section F—F with respect to FIG. 6.

The added advantage of the device is the ability to regulate pressure within the filling system. Sometimes, the pressure in the system can be very high especially when the filling rate of ink into the printer cartridge 10 is slower than the ink supply rate from the pump 30. One of the reasons is a non-perfect nozzle 60 condition of the printer head. Another reason may include air trapped in the nozzle 60 area. In general, all tubes joint and, in particularly the nozzle seal area a has limited pressure limit that it can withstand before ink can leak or burst out. If such a case happens, not only the filling process has failed, but the entire device is fouled. Accordingly a pressure check valve 51 is installed to regulate internal pressure as shown in FIG. 5. The pressure check valve 51 is pre-set to a pressure Y in between pressure X required to fill the printer cartridge and the limit pressure Z that the system can withstand without ink leak or burst such that $X<Y<Z$. Hence actual pressure in the system will always be controlled between X and Y in normal filling conditions. With such an arrangement, whenever pressure builds up in the system during filling to the extent the pressure is greater then Y, the pressure check valve 51 opens to allow ink to flow back, thus reducing pressure of the system under the action of the pump 30. When pressure drops further to below Y, pressure check valve 51 closes and the filling process is back to normal.

Another design aspect applicable to pressure control is the use of a T-joint 81 at the cartridge seal area. The T-joint allows ink to flow straight in the pressure regulating circuit through pressure check valve 51. As well understood, the print nozzle of printer cartridge 10 is very tiny. Therefore, ink flow rate is substantially low, but yet sufficient pressure is required allowing ink to flow through the tiny nozzle 60. As such, it very difficult to strike a perfect balance of high pressure and low flow rate. The T-joint allows ink pressure to stay high enough that enables ink to flow through the printer nozzle 60. At the same time it allows only a small amount of ink flow through the print nozzle 60 and excess ink is re-circulated in the pressure regulating circuit. This results in gentle flow of ink on refilling of the printer cartridge 10, which ensures a best fill result and print quality after refill.

Another added advantage of this invention is the introduction of a damper 80 in between the pump outlet and the inlet to the printer cartridge 10. The damper 80 is in fact a component such as fluid filter as commonly used in a chemical laboratory. It doubles as a filter to filter off foreign, unwanted big size particles (that may clog the printer cartridge's printing nozzle should they enter the printer cartridge 10). The main effect of the damper is analogous to a capacitor in an electronic circuit. It reduces noise and smooths ink flow into the printer cartridge 10. As commonly understood, ink flow at the pump outlet (being pump out by the pump) has gained high pressure. The pressure increase is pulsile as a consequence of the pump 30. The high pressure increases flow rate significantly. Although this high pressure is desired to transport the ink and force it to fill into printer cartridge 10, it also introduces air bubbles as ink is being forced out of the pump like a jet stream. The damper 80 absorbs the pulses and reduces bubbles and thus smooths the ink flow before it is filled into the printer cartridge 10. It therefore, significantly improves both the ink quality and fill ability of the system.

When the filling is completed successfully (i.e. all ink from the ink chamber 21 in the ink replenishment cartridge 20 has been fully consumed) sensor S1 detects that ink is absent in the supply channel. The control electronic picks up the signal and stops the ink filling process immediately. It then activates the final vacuum process for a pre-determined period of time. The final vacuum process reduces internal pressure in the printer cartridge 10 and removes air at the nozzle area 60. The final vacuum process also serves as a priming process to ensure that air bubbles are removed from nozzle 60 and fills all nozzles with ink so that it will be ready for printing immediately. The reduced pressure in the internal chamber of the printer cartridge also ensures no leaking of ink when it is removed from the device.

With the filling process successfully completed, the control electronics change the LED L1 to display orange color light indicating that the filling has been completed successfully. The start button switch B1 will be disabled thus the system will not start another filling cycle. At this stage, the door can be opened and both the printer cartridge 10 and ink replenishment cartridge 20 can be taken out from the device. The printer cartridge 10 is ready to the used again and the empty ink tank 20 can be disposed off.

As a safety measure, in case the ink in the ink chamber 21 in the ink replenishment cartridge 20 is not consumed completely in the pre-determined period of time (e.g. 5 minutes), such as when the user drops in a half used printer cartridge (i.e. there is still plenty of unused ink in the printer cartridge), the control electronics will stop the filling process and perform the final vacuum process. At the end of the process, the control electronic change the LED L3 to display red blinking light indicating that the filling has stopped after a pre-determined period of time.

In case the printer cartridge leaks after removing from the device or during printing, user can put the printer cartridge back into the device together with an ink receiver, close the door so that the system is ready with LED L1 displaying green light, user can press and hold down the start button switch B1 continuously for a pre-determined period of time (e.g. 5 seconds). The system will be activated to start the final vacuum process only. At the end of the vacuum process, the system displays LED L1 in orange light indicating that the printer cartridge can be removed from the device and be used for printing again.

In the event that the device is running with battery power, the control electronics checks for the power level and ensures it is sufficient to complete the entire filling cycle. If the power level is low to the extent that it is unable to complete one filling cycle, the control electronic will change LED L2 to display a flashing red light indicating that the battery power is low that user need to change battery before using it again.

The device as showed in FIG. 6 to FIG. 12 show the concrete realization of the concepts as shown in FIG. 2 to FIG. 5.

The cumulative device is provided with a five-part housing, which is comprised of lower base housing 110, top cover housing 120, left cover housing 130, right cover housing 131 and back panel housing 132. Major internal components of the device are constructed with five main parts, viz. a holder tray 140 with door cover 150, main frame 160, frame linkage 161 and swivel needle holder 170.

In the top cover housing 120, the printed circuit board PCB 42 is mounted. On the PCB, there exists a sensor holder component (fuse holder like component) that allows the ink supply channel to be fixed on the PCB upon assembly. The ink supply passes through two metal tubes separated apart at a short distance. The ink, being electrically conductive, closes the electrical circuit between the two metal tubes when ink flow in the tubing system when filling, thus sending signal to the control electronic 40 indicating the presence of ink in the supply channel 92. On the other side of the PCB, there exists start button switch B1 that is close to start button 121 which is fixed onto start button spring holder 122 before attaching onto top cover housing 120. LED L1 is underneath the start button 121 and LED L2 and LED L3 is directly fix onto start button spring holder 122.

On the back panel housing 132, the main power switch 41 and DC power jack 133 is attached.

On the lower base housing 110, battery connectors 113 are installed and battery compartment door 111 is attached at the bottom side. On the inner side of the lower base housing 110, a sensor PCB 43 with sensors S2 and S3 on it, is attached. Then the main frame 160 is securely mounted onto the lower base housing 110. Upon assembly of the main frame 160, the frame linkage 161 are assembled with attaching cartridge seal holder 162 and cartridge nozzle rubber seal 163 and mount them securely onto the main frame 160 with all required springs 164 and 165 in their position. Then the swivel needle holder 170 is also assembled onto the main frame 160. Finally, the motor 31 and pump 30 are also attached securely onto the main frame 160.

With all the components on the main frame 160 assembled, tubing 90 to 96 and connectors and check valves that link tubes 90 to 96 together are fitted to complete the tubing circuitry. Then electrical wires are connected to various electrical components such as the motor 31, main power switch 41, DC jack 133 and sensor PCB 43 leaving the other end of the main wire connector to be connected to the main PCB 42.

The left cover housing 130 and right cover housing 131 can now be fixed together followed by fixing the back panel housing 132. Finally, the ink supply channel with metal tubing portion is fixed in place onto PCB 42 and the main wire connector is also attached to the main PCB 42. The top cover housing 120 is now attached to complete the device assembly.

The door cover 150 is pre-assembled onto the holder tray 140 separately. The assembled holder tray 140 can now be slid into the device and door cover 150 closed and is clicked securely onto the main device body.

To begin operation, the closed cover 150 is opened and the holder tray 140 is pulled out of the device. In a full open position, the seating position of the printer cartridge 10 and the ink replenishment cartridge 20 is fully exposed to the user. Therefore, user can simply drop the printer cartridge 10 to be filled and an ink replenishment cartridge 20 onto their seating position respectively. Underneath the holder tray, there exists support legs 142 to prevent topple over of the device due to weight of the printer cartridge 10 and ink tank 20 or pressure applied by the user when putting the printer cartridge 10 and ink replenishment cartridge 20 onto their seating position.

The holder tray 140 is then slid into the device by closing the door cover 150 until it clicks securely onto the main device. While sliding in the holder tray, the printer cartridge 10 come into contact with the cartridge nozzle rubber seal 163. This contact is accomplished by a cam mechanism activated by the protruding cam 143 on the holder tray 140 onto the cam surface 165 on the frame linkage 160 to bring down the cartridge seal holder 162. Before printer cartridge 10 reaches the cartridge nozzle rubber seal 163 (i.e. before the cam surfaces meet), the cartridge nozzle rubber seal 163 is above the printer cartridge nozzle surface 60, lifted and maintained in position by spring 165, with sufficient clearance. This ensures the sensitive printer cartridge nozzle 60 is not damaged by the mechanical contact and scratches on mechanical movement. When the cam surfaces start to meet, the printer cartridge 10 is stopped by a stopper 166 on the main frame 160 with the holder tray 140 continuing to slide in. The cam surfaces meet and the frame linkage 161 starts to move down due to the cam mechanism. It brings down the cartridge nozzle rubber seal 163 to be in contact with the printer cartridge surface 60 and compresses springs 164. On reaching a fully closed position, the cartridge is securely positioned by the spring 144 on holder tray 140 and the four springs 164 are being compressed and exert sufficient force that creates a sealing contact that can withstand pre-determined amount of pressure to prevent ink leakage during filling process.

While the holder tray is sliding in, the ink replenishment cartridge 20 is also coming into contact with the needle 171 and 172 held on the swivel needle holder 170. Continuous sliding of the holder tray 140 causes the needles 171 and 172 penetrate through the rubber seal 23 and 24 that connect into the receptacle chamber 22 and ink chamber 21 respectively, thus, completing the fluid communication circuit. The needles 171 and 172 are deep inside the device with safety taken into consideration during designing of the device. It is not easily reachable and thus user is unlikely to be hurt by the needles. The swivel needle holder 170 is spring loaded with a built in spring 173 that maintains it in an upright position that ensures that the end tip of the needles 171 and 172 meet the center of the rubber seals 23 and 24 in ink replenishment cartridge 20 before penetrating. When penetrating, the ink replenishment cartridge 20 is still moving forward due to the continuous sliding of the holder tray 140. This causes strain on the needle 171 and 172 and rubber seal 23 and 24 as the angle has been changed in the movement. The swivel needle holder 170 is therefore designed to allow some degree of rotating movement to correct the angle of the needle during penetrating into the rubber seal 23 and 24 and thus eliminate strain that may cause rubber to be torn and its lose sealing effect on the needle cannula thereby breaking the fluid tightness of the connection in the system.

On proper closing of the door 150 i.e. the holder has fully slid in, the printer cartridge 10 is pressing on sensor switch S3 and the ink tank 20 is pressing on sensor switch S2. At this stage, if power supply is on, the LED L1 will light as a green color indicating the filling process can be started.

LED L1 lighting in an orange color indicates the filling process is completed successfully, whereupon the door 150 is opened and the holder tray 140 is slid out. The sliding out causes the cam surfaces to disengage and open clearance between cartridge nozzle surface 11 and nozzle rubber seal 163. Again, the clearance prevents the cartridge nozzle being damaged by mechanical movement. At the same time, the needless 171 and 172 disengage from the rubber seal 23 and 24 of the ink replenishment cartridge 20. The rubber is automatically self seals back to close holes of penetration and prevent waste ink from leaking out of the ink replenishment cartridge 20.

Therefore, upon the door 150 being fully opened, the ink replenishment cartridge 20 can be dispose off cleanly and the printer cartridge 10 is ready for printing. The device is also ready for the next filling process immediately or any time later on.

What is claimed is:

1. An apparatus for refilling a printer cartridge, said apparatus comprising:

a dock for the printer cartridge, a dock for an ink replenishment cartridge having an ink receiver, an ink draw off conduit adapted to connect a docked printer cartridge to the ink receiver of a docked ink replenishment cartridge with the ink receiver, an ink replenishment draw in conduit to connect an ink replenishment outlet of the docked ink replenishment cartridge to the ink draw off conduit, one of the ink replenishment cartridge and the ink replenishment draw in conduit, and the ink replenishment draw in conduit, being adapted to allow only draw off flow from the ink replenishment cartridge outlet, a circuit completing conduit and at least part of the ink replenishment draw in conduit to connect the ink draw off conduit to the docked printer cartridge, a pump operable to pump in either direction on a circuit defined in part by at least part of the ink draw off conduit and in part by at least part of the circuit completing conduit, a one way valve on the ink draw off conduit between (i) the ink replenishment cartridge dock and (ii) the circuit and the ink draw off conduit, the valve favouring flow to the ink replenishment cartridge dock, and a one way threshold valve on the circuit, wherein a flow system arising from the apparatus is operable in the following modes, (a) an ink draw off mode with the pump operating in a first direction to take ink from within the docked printer cartridge into the ink receiver of the docked ink replenishment cartridge, the draw off mode not involving flow via said one way valve on the circuit, (b) an ink supply mode with the pump operating in a second direction to supply ink from within the docked ink replenishment cartridge into the docked printer cartridge, and (c) an ink re-routing mode with the pump operating in the second direction to re-route ink taken into the flow system from within the docked ink replenishment cartridge in mode (b) operation, the re-routing to:

(1) cycle ink in the conduit when over a threshold pressure of and via the one way threshold valve on the circuit, (2) discharge ink into the ink receiver when over a threshold pressure of a one way threshold valve on the ink draw in the circuit, via one of both said one way threshold valves and both (1) and (2).

2. The apparatus of claim 1, wherein the flow system is subject to, at least in part, electrical control of the pump and/or valving of at least one conduit after being initiated, and the flow system:

(i) can operate in mode (a) and then (ii) while having at least the possibility of acting wholly or in part in mode (c), can operate in mode (b).

3. The apparatus of claim 2, wherein said flow system is operable with the pump operating in a first direction in a mode (d), where mode (d) is a variation of the ink draw off mode (a), and there is a draw off of some fluid from within a mode (b) filled or part filled docked printer cartridge, and the fluid is one of ink and air, and air.

4. The apparatus of claim 3, wherein there is a programmed or electronic control of the pump and/or valving of at least one conduit of the conduiting whereby the flow system iterates the sequence of (I) mode (b) alone or both modes (b) and (c), and (II) mode (d).

5. The apparatus of claim 1, wherein said flow system is operable with the pump operating in the first direction in a mode (d), where mode (d) is a variation of the ink draw off mode (a), and there is a draw off of some fluid from within a mode (b) filled or part filled docked printer cartridge, and the fluid is one of ink and air, and air.

6. The apparatus of claim 5, wherein there is a programmed or electronic control of the pump and/or valving of at least one conduit where the flow system iterates the sequence of (I) mode (b) alone or both modes (b) and (c), and (II) mode (d).

7. The apparatus of claim 1, wherein the flow system includes an electrically controlled pump capable of operating in two directions.

8. The apparatus of claim 1, wherein the pump and valving in the flow system prevents any substantial reverse flow of ink to the flow direction(s) in mode (b) yet will allow for ink within part of the flow system and, if above a threshold pressure, at least some routing of ink to the ink receiver.

9. The apparatus of claim 1, wherein the flow system in mode (b) filters the ink supply prior to its passage into the docked printer cartridge.

10. The apparatus of claim 1, wherein there is an electronic control of the flow system mode responsive to sensors adapted to detect at least one of:

the presence of the docked printer cartridge,
the presence of the ink replenishment cartridge,
the status of the docked printer cartridge,
the status of the docked ink replenishment cartridge,
ink status in the flow system,
the integrity of the flow system, and
the integrity of the flow system relationship with at least one of: the printer cartridge, the ink replenishment cartridge and the ink receiver.

11. The apparatus of claim 1, wherein said ink replenishment cartridge is docked in the dock and said ink replenishment cartridge includes said ink receiver.

12. The apparatus of claim 11, wherein said flow system is connected to at least one of the ink replenishment cartridge, the ink receiver and the printer cartridge by a cannula.

13. A system comprising:
(A) an apparatus for refilling a printer cartridge,
(B) an ink replenishment cartridge,
(C) an ink receiver, and optionally,
(D)the printer cartridge, wherein the apparatus (A) for refilling the printer cartridge includes:
a dock for the printer cartridge,
a dock for the ink replenishment cartridge,
a dock for the ink receiver,
an ink draw off conduit adapted to connect the printer cartridge when docked to the ink receiver,
an ink replenishment draw in conduit to connect an ink replenishment outlet of the docked ink replenishment cartridge to the ink draw off conduit, an appropriate ink replenishment cartridge and/or the ink replenishment draw in conduit being adapted to allow or favour only draw off flow from the ink replenishment cartridge outlet,
a circuit completing conduit and at least part of the ink replenishment draw in conduit to connect the ink draw off conduit to the docked printer cartridge,
the pump operable to pump in either direction on the circuit defined in part by at least part of the ink draw off conduit and in part by at least part of the circuit completing conduit,
a one way valve on the ink draw off conduit between (i) the ink replenishment cartridge and (ii) the circuit and the ink draw off conduit, the valve favouring flow to the ink replenishment cartridge dock, and
a one way threshold valve on the circuit,
wherein a flow system arising from the system is operable in the following modes:
(a) an ink draw off mode with the pump operating in a first direction to take ink from within the docked printer cartridge into the ink receiver of the docked ink replenishment cartridge, the draw off mode not involving flow via said one way valve on the circuit,
(b) an ink supply mode with the pump operating in a second direction to supply ink from within the docked ink replenishment cartridge into the docked printer cartridge, and
(c) an ink re-routing mode with the pump operating in the second direction to re-route ink taken into the flow system from within the docked ink replenishment cartridge in mode (b) operation, such re-routing to:
(1) cycle ink in the circuit when over a threshold pressure of and via the one way threshold valve on the circuit,
(2) discharge ink into the ink receiver when over the threshold pressure of both one way threshold valves or
(3) both (1) and (2).

14. The system of claim 13, wherein said ink replenishment cartridge includes said ink receiver.

15. The system of claim 14, wherein said docking cannula connects at least one of (B) (C) and (D) to the flow system.

16. The system of claim 13, wherein said docking cannula connects at least one of (B) (C) and (D) to the flow system.

17. A method of refilling a printer cartridge comprising:
using a system for refilling the printer cartridge, the system including:
(A) an apparatus for refilling the printer cartridge,
(B) an ink replenishment cartridge having an ink supply reservoir, and
(C) an ink receiver, the ink receiver is one of part of the ink replenishment cartridge and separate from the ink replenishment cartridge, wherein the apparatus (A) for refilling the printer cartridge includes:
a dock for the printer cartridge,
a dock for the ink replenishment cartridge,
a dock for the ink receiver, and
an ink draw off conduit adapted to connect the printer cartridge when docked to the ink receiver, said conduit having two same direction one way valves each favouring flow from the dock for the printer cartridge to the dock for the ink receiver,
an ink replenishment draw in conduit to connect the ink replenishment outlet to the ink draw off conduit, the ink replenishment cartridge and/or the ink replenishment draw in conduit adapted to allow or favour only draw off flow from the ink replenishment outlet of the ink replenishment cartridge,
a circuit completing conduit and at least part of the ink replenishment draw in conduit to connect the ink draw off conduit to the printer cartridge when docked,
a pump operable to pump in either direction on a circuit defined in part by at least part of the ink draw off conduit and in part by at least part of the circuit completing conduit,
(I) dock connecting:
(1) the ink supply reservoir of an ink replenishment cartridge,
(2) the ink reservoir of a printer cartridge, and
(3) the ink receiver into the apparatus, and,
(II) using the apparatus by:
(a) drawing off at least some of any ink from within the ink reservoir of the printer cartridge and passing that fluid into the ink receiver,
(b) supplying ink from the ink supply reservoir of the ink replenishment cartridge into the ink reservoir of the printer cartridge, and
(c) halting flow of ink to the ink reservoir of the printer cartridge when
(i) the ink replenishment cartridge is empty of ink, and
(ii) the ink reservoir of the printer cartridge is full of ink,
wherein halting of the supply of ink, when the ink reservoir of the printer cartridge is full includes one of diverting and cycling, in the circuit, ink already taken from within the ink replenishment cartridge.

18. The method of claim 17, wherein step (a) and step (b) require opposite rotation of a pump.

19. The method as claimed in claim 18, further comprising:

(d) relieving of pressure from within the ink reservoir of the filled printer cartridge by drawing off some fluid therefrom.

20. The method as claimed in claim 17, further comprising:

(d) relieving of pressure from within the ink reservoir of the filled printer cartridge by drawing off some fluid therefrom.

21. The method as claimed in claim 17, wherein at least one of the docks uses a cannula.

* * * * *